United States Patent [19]

Gremillion

[11] Patent Number: 4,911,664

[45] Date of Patent: Mar. 27, 1990

[54] WEED CUTTING AND SHREDDING ATTACHMENT FOR TROLLING MOTOR

[76] Inventor: Ernest J. Gremillion, P.O. Box 556, Larose, La. 70373

[21] Appl. No.: 228,120

[22] Filed: Aug. 4, 1988

[51] Int. Cl.[4] ..... B63H 1/28

[52] U.S. Cl. ..... 440/73; 416/247 A; 416/146 R

[58] Field of Search ..... 30/276, 122; 440/73; 416/247 A, 146 B, 146 R

[56] References Cited

U.S. PATENT DOCUMENTS

| | | | |
|---|---|---|---|
| 726,180 | 4/1903 | Miller . | |
| 732,568 | 6/1903 | Lee . | |
| 1,390,397 | 9/1921 | Svenson . | |
| 4,080,099 | 3/1978 | Snyder | 416/146 R |
| 4,447,215 | 5/1984 | Govan | 440/71 |
| 4,450,670 | 5/1984 | Robinson | 416/247 |
| 4,609,361 | 9/1986 | Sumino | 440/73 |
| 4,676,758 | 6/1987 | Dennis | 440/73 |

*Primary Examiner*—Douglas D. Watts

*Attorney, Agent, or Firm*—Fleit, Jacobson, Cohn, Price, Holman & Stern

[57] ABSTRACT

A weed cutting and shredding attachment for an electric trolling motor including a sharpened cutting blade oriented with the sharp edge thereof adjacent to the path of movement of the leading edge of the propeller blades on an electric trolling motor together with a mounting structure for effectively mounting the cutting element from the trolling motor.

8 Claims, 1 Drawing Sheet

WEED CUTTING AND SHREDDING ATTACHMENT FOR TROLLING MOTOR

BACKGROUND OF THE INVENTION

1. FIELD OF THE INVENTION

This present invention generally relates to a weed cutting and shredding attachment for an electric trolling motor including a sharpened cutting blade oriented with the sharp edge thereof adjacent to the path of movement of the leading edge of the propeller blades on an electric trolling motor together with a mounting structure for effectively mounting the cutting element from the trolling motor.

2. INFORMATION DISCLOSURE STATEMENT

When fresh water fishing such as when fishing for bass, a specially designed bass boat is frequently used. Most bass boats, in addition to a large gasoline powered engine mounted on the rear, are equipped with an electrically powered trolling motor mounted usually on the front of the boat. The trolling motor is constructed for normally laying flat on the deck of the boat adjacent the bow and is constructed to be mounted from the boat so that the drive motor and propeller are in the water when being utilized and taken out of the water when not being utilized with the change in positions requiring only a very short time. When fishing, the large gasoline engine on the rear of the boat is used to drive the boat to a fishing area. The gasoline engine is then stopped and the electric trolling motor deployed into the water with the trolling motor then being used to move the boat in the selected fishing area in a very slow and quiet manner. The electric trolling motor is usually foot-operated which permits the fisherman in the front of the boat to control the position of the boat while leaving both of his hands free for fishing. The trolling motor includes a housing, known as the "foot" which contains the electric motor having a shaft protruding from the trailing edge of the housing and a propeller, usually of plastic, being affixed to the shaft and thus being driven by the shaft and electric motor. When in operation, the "foot" of the trolling motor and the propeller are underwater and the juncture between the stationary trolling motor "foot" or housing and the rotatable propeller usually includes a small gap between the propeller hub and the housing or "foot".

As is well known, optimum fishing spots in fresh water are frequently found in "pot holes" and these areas are usually surrounded by dense grass, vegetation and the like. There has been an ongoing problem that debris such as weeds, grass, vegetation and even lost fishing lines have a tendency to enter the above-mentioned gap and wind around the shaft. This frequently results in reduced efficiency of the trolling motor and can damage the seals around the shaft which keep water from coming into contact with the electric motor thus necessitating major repair of the trolling motor. While some efforts have been made to alleviate this problem, there has not been developed an attachment associated with the trolling motor and propeller blades similar to this invention.

SUMMARY OF THE INVENTION

An object of the present invention is to provide an attachment for an electric trolling motor that will effectively cut and shred weeds, grass and similar vegetation to preclude such material from entering the gap between the electric trolling motor housing and propeller hub and winding on the shaft as well as preclude this material from winding on the propeller hub or trolling motor housing.

Another object of the invention is to provide an attachment in accordance with the preceding object that includes a sharpened blade having a sharpened edge disposed closely adjacent to the leading edge of propeller blades on a trolling motor with the sharpened blade being disposed in a transverse radial plane through the shaft with the sharpened edge of the blade extending radially adjacent the path of movement of the leading edges of the propeller blades and angularly related to the leading edges of the propeller blades as the leading edges pass the sharpened edge for effectively shearing grass, weeds and other vegetation that is moved toward the sharpened edge by the leading edges of the propeller blades.

A further object of the invention is to provide an attachment in accordance with the preceding objects in which the blade is supported by a bracket structure integral therewith with the bracket structure being secured to the trolling motor housing in a stationary and secure manner which enables the attachment to be secured to existing trolling motors and also incorporated into newly manufactured trolling motors.

These together with other objects and advantages which will become subsequently apparent reside in the details of construction and operation as more fully hereinafter described and claimed, reference being had to the accompanying drawings forming a part thereof, wherein light numerals refer to light parts throughout.

DESCRIPTION OF THE PREFERRED EMBODIMENT

Figure 1:
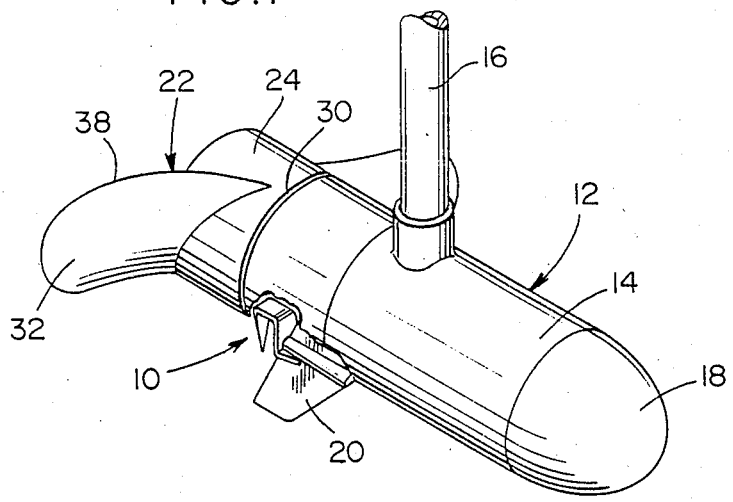
FIG. 1 is a perspective view of a trolling motor with the attachment of the present invention added thereto.
Figure 2:
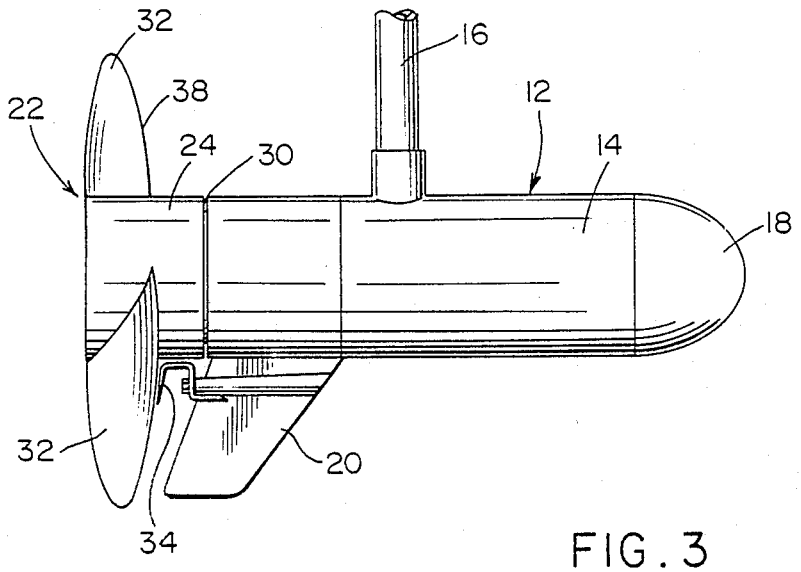
FIG. 2 is a side elevational view of the construction of FIG. 1 illustrating the relationship of the attachment to the housing and propeller.
Figure 4:
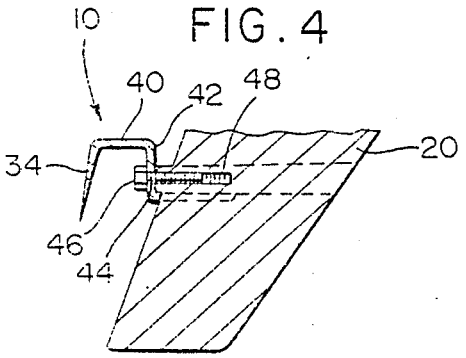
FIG. 4 is a sectional view taken generally along section lines 4—4 on FIG. 3 illustrating the mounting structure for securing the attachment to the protective fin on the trolling motor housing.

Referring now specifically to the drawings, the weed cutting and shredding attachment of the present invention is generally designated by reference numeral 10 and is associated with an electric trolling motor 12 having the usual cylindrical housing or foot 14 mounted at the lower end of a supporting structure 16 in a conventional manner. The motor housing 14 usually includes a rounded forward end 18 and is generally cylindrical in cross-sectional configuration and provided with a depending fin or skeg 20 along the bottom edge thereof and adjacent the rear edge of the housing 14 as illustrated in FIG. 2. Immediately behind the housing 14 is a propeller generally designated by the numeral 22 and which includes a cylindrical hub 24 of generally the same diameter as the housing 14 and secured to a motor shaft 26 by any suitable fastening structure 28. A narrow gap 30 exists between the rotatable hub 24 and the stationary cylindrical housing 14. The housing 14, protective fin 20 and propeller hub 24 and propeller blades 32 may be constructed of various materials, including plastic, and all of these components as aforementioned are conventional and commercially available from various manufacturers. The details of the supporting structure for mounting the trolling motor from the bow or other portion of a boat are not shown since they do not form part of the present invention.

The attachment 10 is associated with the trolling motor 12 in a manner to prevent weeds, grass and other debris from winding around the propeller hub 24, the housing 14 and also preventing such material from entering the gap 30 and winding around the drive shaft 26.

Figure 3:
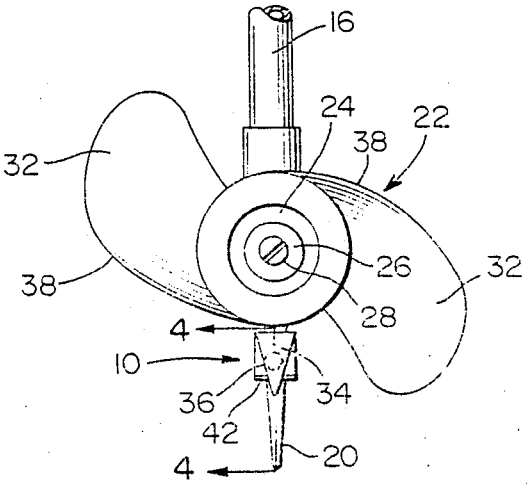
FIG. 3 is a rear elevational view of the trolling motor illustrating the relationship of the attachment and propeller blades.

As illustrated, the attachment 10 includes a cutting element or blade 34 that includes a sharpened edge 36 disposed adjacent the path of movement of the leading edges 38 of the propeller blades 32. FIGS. 2 and 3 illustrate the close association of the cutting blade 34 with the leading edge 38 of each of the propeller blades 32 so that as the leading edge 38 of a propeller blade 32 passes closely adjacent the surface of the cutting blade or element 34, any debris, weeds, vegetation or the like lodged on the leading edge 38 of the propeller blade 32 will be effectively cut, sheared or shredded so that such material will separate from the propeller 22 rather than moving inwardly along the leading edges of the propeller blades 32 and winding on the hub 24, entering the gap 30 or winding on the housing 14. As illustrated in FIG. 3, the sharpened edge 36 of the cutting element 34 is inclined in relation to a radius extending from the rotational axis of the shaft 26 so that the included angle between the rearwardly curved leading edge 38 of the propeller blade 32 and the cutting edge 36 is such that the material being cut will be forced radially outwardly of the leading edge 38 of the propeller blade 32 due to the continuous wedging action provided by the angle between the sharpened edge 36 and the leading edge 38 of the propeller blade 32.

The cutting element 34 is provided with a bracket structure 40 for detachably and removably securing the attachment to the trolling motor. In the embodiment illustrated, the bracket structure 40 includes a plate-like structure positioned closely adjacent the periphery of the hub 24 so that the cutting element 34 extends from a point adjacent the periphery of the hub 24 outwardly adjacent the path of movement of the leading edges 38. The bracket structure 40 also includes a laterally extending mounting plate 42 having an aperture 44 therein for receiving a fastening bolt, screw or other fastening device 46 which extends therethrough and is screw threaded into an internally threaded bore 48 formed in the depending protective fin 20 on the trolling motor housing 14. Thus, with this structure, the attachment 10 is rigidly, securely and detachably secured to the fin 20 in order to orient the cutting element 34 is optimum relationship to the leading edge 38 of the propeller blade 32. The attachment 10 may be constructed of metal such as stainless steel or of other well-known, rigid, long-lasting and non-corroding components such as plastic, graphite and the like. The blade or cutting element 34 may be a disposable and replaceable element mounted on a suitable carrier or mounted directly onto the casting forming the trolling motor housing. A disposable blade, similar to the disposable blade used in various razor and razor blade assemblies may be utilized, thus reducing the cost of replacing the blade or the cost of removing the blade for sharpening. It is also within the purview of the present invention to provide an integral cutting blade or element that is cast monolithically with the trolling motor housing 14. Also, since motor housings for trolling motors are constructed in various configurations, shapes and sizes, the mounting structure for the cutting blade or element may vary depending upon the installational requirements necessary to effectively secure a cutting blade or element to various types of trolling motor housings. In some instances, a housing encircling clamp band may be used to secure the cutting blade or element in place. The cutting blade or element may be of various configurations and shapes including triangular even though only one edge needs to be sharpened, inasmuch as it is associated with the leading edges of the propeller blades when the propeller is rotating in only one direction.

In the embodiment illustrated, the attachment is secured to the trolling motor housing fin 20 by using one or more cap bolts threaded into tapped holes or bores. In one effective embodiment, the attachment is approximately 4" in length, 1½" wide at its widest point and narrowing to 1⅛". The blade or cutting element is generally perpendicular to the mounting bracket 40 although this angle varies depending upon the contour of the leading edges of the propeller blades and, as indicated previously, may be constructed of stainless steel or other materials and sharpened along the edge associated with the leading edges of the propeller blades. If the trolling motor is reversible, the attachment is not effective when the propeller is driven in a reverse direction.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resulted to, fall within the scope of the invention which is intended to be limited only by the scope of the pending claims.

What is claimed as new is as follows:

1. A weed cutting and shredding attachment for an electric trolling motor of the type having an electric motor housing, a drive shaft extending therefrom with a propeller mounted on the drive shaft, said propeller including a propeller hub adjacent the housing and radial blades on the hub in which weeds, vegetation and the like tend to wind around the hub, housing and enter a gap between the rotatble propeller hub and the stationary housing and thus wind around the shaft, said attachment comprising a cutting blade having a cutting edge oriented closely adjacent the path of movement of the leading edges of the propeller blades to cut, shear and shred weeds, grass and the like being carried by the leading edges of the propeller blades and means supporting the cutting blade from the trolling motor, said cutting edge being disposed radially of the propeller hub with the inner end of the cutting edge being disposed adjacent the hub and the outer end spaced therefrom, said cutting edge being inclined in relation to a radius extendng from the center of rotation of the hub and combining with the leading edges of the propeller blades to form an included angle to urge weeds, grass and the like radially outwardly of the leading edges of the propeller blade to clean the blades of the propeller and preclude material winding on the propeller hub, entering the gap and winding on the shaft and winding on the housing.

2. The structure as defined in claim 1 wherein said housing includes a depending fin immediately forwardly of the propeller hub to protect the propeller blades from coming into contact with rigid underwater obstructions, said cutting blade being supported from said fin.

3. The structure as defined in claim 2 together with a bracket structure having said cutting blade at one edge thereof with the cutting edge being formed on said blade, said bracket structure extending longitudinally of the propeller hub adjacent the outer surface thereof and bridging the gap between the rotating hub and stationary motor housing and including a portion positioned along the rearward edge of the depending fin, and fastening means interconnecting the bracket structure and depending fin to secure the cutting blade in position immediately forwardly of the leading edges of the propeller blades.

4. The structure as defined in claim 3 wherein said cutting blade is disposed in a transverse radial plane perpendicular to the rotational axis of the propeller hub.

5. A weed cutting and shredding device for use with a boat propeller including a hub and radial blades on the hub on which weeds, vegetation and the like tend to wind when the propeller is rotated when propelling a boat, said device comprising a stationary cutting blade having an elongated cutting edge, said cutting edge adapted to extend radially along the edges of the radial blades on the hub and adapted to be oriented closely adjacent the path of movement of the leading edges of the propeller blades to cut, shear and shred weeds, vegetation and the like being carried by the leading edges of the propeller blades and means supporting the cutting blade, said cutting edge including an inner end adapted to be disposed adjacent the hub and an outer end spaced from the inner end, said cutting edge adapted to be inclined in relation to a radius extending from the center of rotation of the hub and adapted to combine with the leading edges of the propeller blades to form an included angle to urge weeds, vegetation and the like radially outwardly of the leading edges of the propeller blades to clean the blades of the propeller and preclude material winding on the propeller hub.

6. The structure as defined in claim 5 wherein said elongated cutting blade is a substantially planar member adapted to be disposed in a transverse radial plane perpendicular to the rotational axis of the propeller hub.

7. In combination, an electric trolling motor having a housing, a drive shaft extending rearwardly from the housing, a propeller mounted on the drive shaft and including a hub closely associated with the housing and radially extending propeller blades with each propeller blade having a forwardly oriented leading edge curving away from the direction of rotation of the propeller, a stationary blade member supported from said housing and extending radially in relation to the hub and including a sharp edge positioned radially along the path of movement of the leading edges of the propeller blades and oriented in adjacent, generally parallel relation to the path of movement of the leading edges of the propeller blades with the sharp edge being inclined and cooperating with the leading edge of the propeller blades to form a generally wedge-shaped included angle between the radial sharp edge on the stationary blade member and the radial leading edges of the propeller blades to cut and wedge radially outwardly the material carried toward the sharp edge of the blade member by the leading edges of the propeller blades.

8. The combination as defined in claim 7 wherein said blade member is generally planar and disposed in a radial plane transverse to and perpendicular to the rotational axis of the propeller.

* * * * *